United States Patent [19]

Lagus et al.

[11] 4,392,376

[45] Jul. 12, 1983

[54] METHOD AND APPARATUS FOR MONITORING BOREHOLE CONDITIONS

[75] Inventors: Peter L. Lagus, Olivenhain; Edward W. Peterson, Del Mar; William O. Hicks, San Diego, all of Calif.

[73] Assignee: S-Cubed, San Diego, Calif.

[21] Appl. No.: 249,622

[22] Filed: Mar. 31, 1981

[51] Int. Cl.[3] ..... E21B 47/10

[52] U.S. Cl. ..... 73/155; 166/250

[58] Field of Search ..... 73/155; 166/250, 324; 175/40

[56] References Cited

U.S. PATENT DOCUMENTS

| | | | |
|---|---|---|---|
| 2,629,446 | 2/1953 | Freling et al. | 73/155 |
| 3,592,056 | 7/1971 | Bernoix | 73/155 |
| 3,871,218 | 3/1975 | Louis | 73/155 |
| 4,282,750 | 8/1981 | Prats et al. | 73/155 |
| 4,292,842 | 10/1981 | Hallmark | 73/155 |

*Primary Examiner*—Howard A. Birmiel

*Attorney, Agent, or Firm*—Fitch, Even, Tabin, Flannery & Welsh

[57] ABSTRACT

A method and apparatus is disclosed for monitoring flow conditions in boreholes or the like wherein a test interval is defined by a packer system and contains a substantially incompressible fluid or liquid making it difficult to conduct measurements from the surface. According to the method and apparatus of the present invention, a variable volume device is arranged within the test interval along with a suitable flow monitor which may comprise the variable volume device itself, the variable volume device being operable to limit pressure variation within the test interval and thereby minimize compliance effects over a predetermined test period. Preferably, the variable volume device is coupled with a pressure monitor for maintaining substantially constant pressure in the test interval. In different embodiments, an initial pressure differential is established between the test interval and the surrounding formation by operation of the same variable volume device or by means of a second variable volume device. Where the test interval is defined by a guarded straddle packer forming a guard zone at one or both ends of the test interval, the apparatus and method of the invention may be employed for monitoring flow conditions in a guard zone or guard zones with or without corresponding use of the method and apparatus in the test interval.

35 Claims, 4 Drawing Figures

FIGURE 3
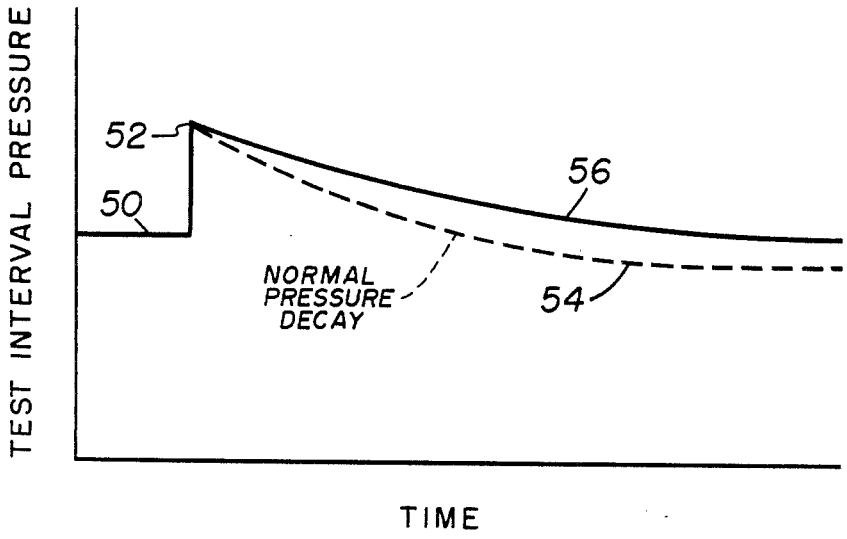
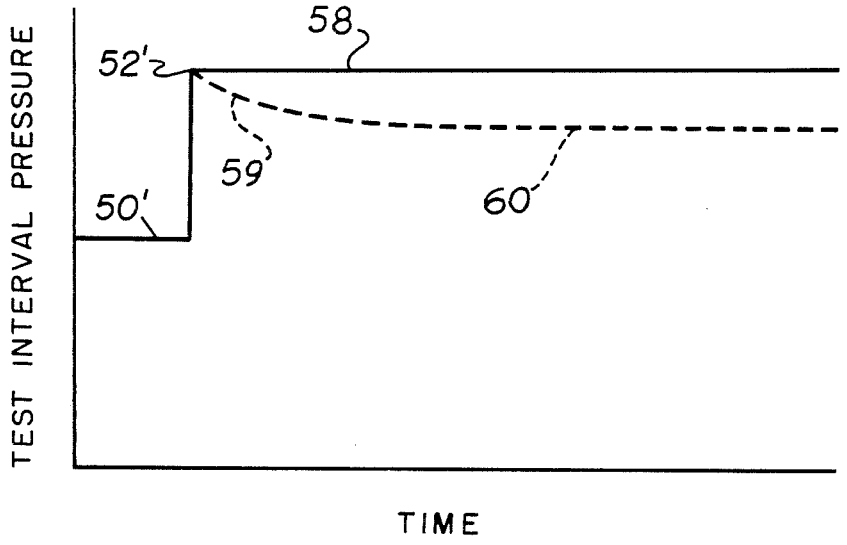
FIGURE 4

METHOD AND APPARATUS FOR MONITORING BOREHOLE CONDITIONS

BACKGROUND OF THE INVENTION

The present invention relates to a method and apparatus for monitoring flow conditions within a borehole or the like filled with a substantially incompressible fluid and more particularly to such a method and apparatus wherein the test interval is defined by a packer assembly preferably comprising means forming at least one additional guard zone in order to facilitate measurement of flow conditions in the borehole.

In situ measurement of permeability in various underground formations has long been of importance for example in connection with oil and gas wells, including tight gas sand formations, also in connection with development of underground storage facilities for waste nuclear materials and in mining operations, particularly those employing solution mining or leaching techniques.

In applications of the type described above, it is essential to accurately characterize permeability of the underground formations of interest. In many of these applications, the underground formations have minimum permeability resulting in limited flow between the formation and the test interval so that it is particularly difficult to obtain accurate information. For example, in waste nuclear storage facilities, minimum permeability is essential in order to assure that the nuclear materials will not leach or seep into the underground formation and escape from the storage facility over long periods of time.

In the prior art, substantial effort has been expended in developing techniques for characterizing permeability of such underground formations by studying fluid flow characteristics for the formation. The relationship between permeability and flow characteristics has been well established, for example, under Darcy's Law or modifications thereof which define the relationship of permeability in connection with fluid flow through a substrate in response to a given pressure differential or head. Additional parameters such as porosity, saturation, fluid viscosity, threshold pressures, temperature, previous testing history, fracture extent, etc. may be of importance in accurately determining such permeability values.

A guarded straddle packer assembly is disclosed in a co-pending application entitled "Method and Apparatus for In Situ Determination of Permeability and Porosity" filed by Peter L. Lagus and Edward W. Peterson and assigned to the assignee of the present invention, now U.S. Pat. No. 4,353,249 issued October 12, 1982. That reference sets forth further information and additional prior art references concerning the measurement or inference of permeability from flow characteristics within a test interval defined along a borehole or the like. As is further described in that reference, such permeability tests may be conducted by measuring flow characteristics in either "in-flow" or "out-flow" tests depending upon the relative pressures in the test interval and in the surrounding formation. In any event, a pressure differential is established therebetween for purposes of inducing flow as a means for determining or inferring permeability and other formation characteristics.

The method and apparatus of the above noted reference is adapted for facilitating flow measurements in formations characterized by much lower permeability than has generally been measurable in the prior art. The guarded straddle packer assembly of the above noted reference was described in connection with fluid systems, either gases or liquids, within its test interval. However, it was found to be substantially more difficult to conduct such tests where the fluid filling the test interval consisted of a substantially incompressible liquid. In such situations, volumetric flow between the test interval and the surrounding formation tends to be even less than in similar situations where the test interval and surrounding porous formation are filled with a gas or the like.

The substantially greater mass of a substantially incompressible liquid creates additional effects tending to interfere with accurate measurements of flow characteristics and associated determination or inference of permeability values. Initially, within a gaseous system, it is relatively easy to conduct the fluid to the surface for measurement of certain characteristics. However, with a liquid being contained in the borehole test interval located for example thousands of feet below the surface, the need for such surface measurements creates a very substantial hydrostatic head interfering with or even preventing accurate measurements of the type contemplated by the present invention.

Use of a substantially incompressible liquid component within the test interval also tends to create or amplify "compliance effects" which may similarly interfere with or prevent accurate measurement of flow characteristics. In this regard, the term "compliance effects" refers to volumetric changes which may take place in any part of the system, either within the liquid itself, the packer system or even the borehole walls, particularly as a result of substantial pressure variations occurring within the test interval.

Accordingly, there has been found to remain a need for a method and apparatus for more accurately monitoring conditions within a borehole test interval containing an essentially incompressible liquid.

SUMMARY OF THE INVENTION

It is therefore an object of the invention to provide a method and apparatus for monitoring flow conditions within a borehole or the like filled with a substantially incompressible fluid by developing a pressure differential between the test interval and the surrounding formation for inducing flow therebetween, arranging a variable volume device in communication with the test interval and varying its effective volume in order to limit pressure variation in the test interval and thereby minimize system compliance effects within the test interval while simultaneously monitoring selected flow conditions within the test interval.

In most applications where the borehole is filled with a substantially incompressible fluid, the variable volume device itself will serve as the flow monitoring means for example by operating the variable volume device to maintain constant pressure, volume variation thereby being an indication of flow.

The variable volume device may comprise a cylinder and piston assembly or the like arranged within the test interval itself or within an adjacent portion of a packer assembly, for example, the cylinder and piston assembly being operable for varying its effective volume in order to limit pressure variation within the test interval. Within an "out-flow" type test, the cylinder and piston assembly or variable volume device would slowly expand in order to limit pressure variation within the test interval. Similarly, the cylinder and piston assembly or other variable volume device could be adapted to gradually contract in order to achieve the same result during "in-flow" type tests. Preferably, the volumetric rate of change of the piston is related to flow into or out of the test interval.

It is a further object of the invention to provide such a method and apparatus wherein the test interval is defined by a guarded straddle packer assembly of the type disclosed in the above noted co-pending reference. The method and apparatus of the present invention is considered to be particularly adaptable for use with such a device because of the ability of the guarded straddle packer assembly for facilitating more precise monitoring of flow conditions within the test interval. A guarded straddle packer assembly as contemplated in this aspect of the invention includes central packers defining a test interval along with spaced-apart guard packers defining guard zones at each end of the test interval.

The method and apparatus of the present invention could also be employed in testing procedures commonly referred to as "whole hole testing" where a test interval is formed between a single expandable packer and an end of the shaft. A single additional guard packer could then be employed to form a guard zone at one end of the test interval. Tests of this type are employed, for example, to determine formation characteristics at different locations as the borehole is being drilled or formed.

It is also a further object of the invention to provide a method and apparatus for monitoring flow conditions within a liquid filled test interval wherein the variable volume device is coupled with a transducer for measuring pressure within the test interval. The variable volume device may then be driven by the pressure transducer or by a suitable interlinking device, such as a servo unit, in order to better limit pressure variation within the test interval. Even more preferably, such a method and apparatus may be employed with the variable volume device being operated by the pressure transducer for maintaining a substantially constant pressure within the test interval. Volumetric changes of the variable volume device will then provide a direct indication of flow into or out of the test interval. The ability to maintain constant pressure within the test interval is further desirable since it tends to eliminate the possibility of compliance effects within the entire system including the test interval, packer assembly, borehole walls, etc.

It is also an object of the invention to employ the method and apparatus of the present invention for monitoring flow conditions within an enclosure formed along the length of a borehole by a guarded straddle packer assembly. Initially, a variable volume device could be employed in the central test interval of the guarded straddle packer in the same manner described above. However, in some applications, the greater length or permeability of the test interval may result in excessive flow into or out of the surrounding formation making it more feasible to use conventional flow monitoring means for the test interval. Because of the shorter length of a guard zone formed at one or both ends of the test interval, the method and apparatus of the present invention could be used to advantage for more precisely measuring the relatively limited flow into or out of the guard zone or zones. It would also of course be possible under suitable conditions to employ the method and apparatus of the present invention for simultaneously monitoring flow in the central test interval as well as in one or more guard zones formed by a straddle packer assembly.

The method and apparatus of the present invention could of course also be employed with other packer systems in addition to those described herein.

The invention also preferably contemplates a method and apparatus wherein an initial stressed condition is developed within the test interval and within the surrounding system including the packer assembly, the contained fluid, and the borehole walls. Such a stressed condition is established by initially creating a relatively large pressure differential between the test interval and the surrounding formation. As the pressure differential then tends to diminish, the variable volume device may be operated to limit pressure variation within the test interval or even to maintain constant pressure as described immediately above. Initial stressing or pressurization of the test interval may be produced for example by means of the same variable volume device or by a second variable volume device. For example, one variable volume device having a relatively large volumetric displacement could be operated to create the initial pressure differential. Upon resulting decay of the pressure differential because of flow into or out of the test interval, a second variable volume device could then be operated in the manner described above for limiting pressure variation within the test interval in accordance with the preceding objects of the invention.

It is also a particular object of the invention to provide a method and apparatus for measuring constant pressure flow without the influence of system compliance effects.

Additional objects and advantages of the invention are made apparent in the following description having reference to the accompanying drawings.

BRIEF DESCRIPTION OF THE DRAWINGS

In the drawings:

FIG. 3 is a graphical representation of a pressure trace for a test interval during operation of the present invention.

FIG. 4 is a similar graphical representation of a pressure trace for the test interval following development of an initial stressed condition therein.

DESCRIPTION OF THE PREFERRED EMBODIMENT

Figure 1:
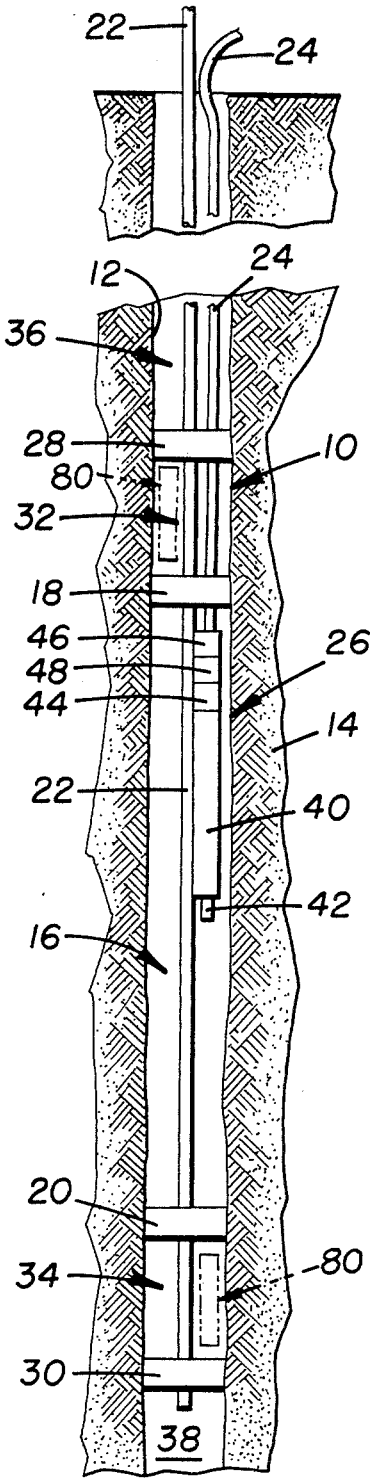
FIG. 1 is a generally schematic representation of a packer assembly arranged in a borehole to define a test interval while including a variable volume device and associated apparatus according to the present invention.

Referring now to the drawings and particularly to FIG. 1, apparatus for monitoring flow conditions and the like within a borehole in order to carry out in situ permeability determinations, for example, includes a packer assembly 10 arranged within a borehole 12 extending through an underground formation of interest, generally indicated at 14. The packer assembly 10 is preferably of a guarded straddle packer configuration as described in greater detail below in order to particularly adapt the invention for monitoring very low flow rates within the borehole in accordance with low permeability values for the surrounding formation. However, it will be apparent that the method and apparatus of the present invention may also be employed in conjunction with other packer means for defining a test interval along the length of the borehole.

As described in greater detail below, the method and apparatus of the present invention may be employed in conjunction with a test interval 16 defined along the length of the borehole by a pair of spaced-apart packers such as those indicated at 18 and 20. However, as may be seen in FIG. 2, the method and apparatus of the present invention may also be employed within a test interval formed adjacent an end of the borehole by means of a single packer in a technique generally referred to as "whole hole testing."

In accordance with the prior art, such as the copending reference noted above, surface equipment (not shown) may be employed in conjunction with the packer assembly both for locating the packer assembly within the borehole and for receiving monitored data from the test interval and other portions of the borehole as described in greater detail below. Referring particularly to FIG. 1, the packer assembly 10, and other apparatus of the invention as described below, is supported within the borehole by means of a tubing string 22, a tube bundle 24 providing any combination of electrical or fluid (either gas or liquid) communication or transmission between the packer assembly and the surface for necessary controls and passage of monitored data.

The method and apparatus of the invention particularly contemplate the use of a variable volume device 26 which performs two functions within the method of the invention. Initially, the variable volume device 26 develops an initial pressure differential between the test interval 16 and the surrounding formation 14. However, this function may also be carried out by means other than the variable volume device 26, such as the separate variable volume device described below in connection with FIG. 2. Furthermore, since the specific amount of the pressure differential is not particularly critical within the present invention, the initial pressure differential could also be developed for example by fluid injection from the surface.

In any event, the variable volume device 26 necessarily performs a second function simultaneously as flow conditions are being monitored within the test interval.

During the monitoring of flow conditions, the effective volume of the variable device 26 is adjusted or varied in order to limit pressure variation within the test interval. In this regard, the invention preferably contemplates operation within a test interval which is essentially filled with a generally non-compressible fluid such as water or other liquids of relatively substantial mass. Accordingly, it is particularly difficult to achieve accurate monitoring of low flow conditions within the test interval from the surface since the test interval may be located thousands of feet underground. The difficulty of communicating liquids between the test interval and the surface in order to maintain test control from the surface would necessarily be difficult because of possibilities of leakage and because of the substantial hydrostatic head involved in a column of the liquid extending from the test interval to the surface.

The difficulty in conducting such measurements within the test interval are even more apparent when it is realized that flow of a liquid, either in to the test interval from the surrounding formation during "inflow" type tests or out of the test interval into the surrounding formation during "out-flow," entails much smaller flow volumes than when the test interval and surrounding formation are filled with a gaseous fluid. For example, whereas low permeability conditions in the formation might result in a given flow rate for gaseous fluid, the introduction of a liquid into the test interval and surrounding formation may reduce the flow rate by a factor of approximately 100. Thus, with a gaseous fluid filling the test interval and the surrounding formation, a representative flow rate might be measured in terms of standard cubic centimeters per minute. On the other hand, with the test interval and surrounding formation being filled with a liquid, representative flow rates might be on the order of 1/100 of a cubic centimeter per minute. Accordingly, the difficulty in obtaining precise data during monitoring of flow conditions for a liquid within such borehole tests are substantially more difficult than with a gaseous fluid.

The relative mass of the liquid within the test interval and the low flow rates to be monitored cause additional difficulty in obtaining accurate results because of factors such as compliance effects, packer bypass flow and system leakage. Before summarizing the manner in which the present invention overcomes these problems, a definition is given as to these various factors. Initially, "compliance effects" include volumetric changes which tend to appear in any part of the system as conditions, notably pressure, change within the system. For example, such changes normally result from substantial pressure changes either within the borehole or specifically within the test interval itself. As pressure changes within the test interval, even a substantially incompressible liquid such as water may exhibit some limited volumetric change. Similarly, the expandable packers, particularly packers which are inflated by gases or liquids, may tend to exhibit some movement or volumetric change within the borehole in response to pressure changes. Furthermore, even the walls of the borehole may exhibit slight movement resulting in a volumetric change for the borehole and particularly for the test interval during such pressure changes. Even though these volumetric changes may be very slight, they become significant during the monitoring of very low flow rates of the type referred to above.

The term "packer bypass flow" generally relates to the characteristics of the formation itself, improper seating of the packers or striations or cracks along the surface of the borehole which permit fluid to bypass the packers along the axis of the borehole in a manner not truly representative of permeability characteristics for the surrounding formation. Such bypass factors will naturally introduce errors in permeability values inferred from flow data taken within the test interval and packer assembly. In addition to leakage about the packers, it was also noted above that serious leakage problems would be possible for any conduits providing liquid communication between the various zones of the packer assembly and the surface.

Figure 2:
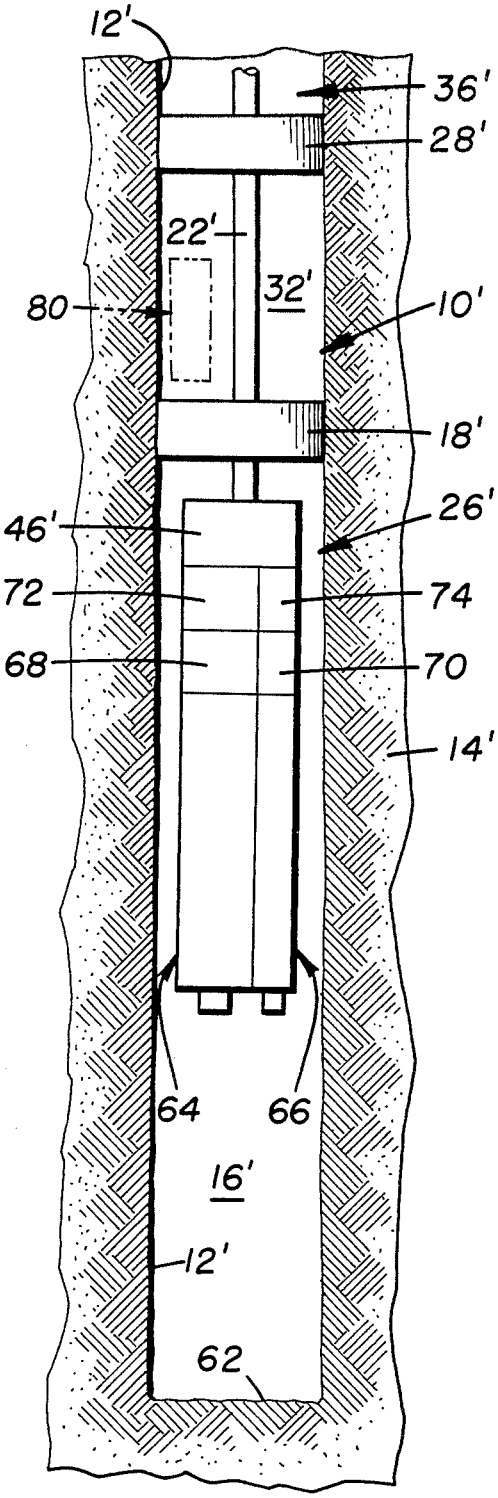
FIG. 2 is a schematic representation generally similar to FIG. 1 while including a modified variable volume device according to the present invention as well as a modified packer assembly particularly adapted for whole hole testing.

Before describing the embodiments of the invention as illustrated in FIGS. 1 and 2 in greater detail, it is noted that the method and apparatus of the present invention overcome these effects in the following manner. Initially, the possibility of liquid leakage in conduits between the packer assembly and the surface is eliminated by monitoring pressure within the test interval itself in conjunction with a variable volume device arranged in immediate communication with the test interval. In this regard, the variable volume device is preferably mounted within the test interval itself. However, it will be apparent that the variable volume device could also for example be a piston and cylinder arrangement formed for example as a portion of the tubing string which supports the packer assembly in the borehole. The problem of compliance effects is overcome by the same combination and furthermore by a preferred method of operation wherein a pressure differential is developed between the test interval and the surrounding formation with flow conditions then being monitored while simultaneously operating the variable volume device for limiting pressure change or even maintaining constant pressure within the test interval.

The minimizing of pressure changes within the test interval also tends to eliminate or minimize compliance effects for various parts of the system including the liquid itself as well as the packer assembly and the borehole walls. In a preferred manner of operation described below in connection with FIG. 4, the variable volume device of the invention is preferably adapted to maintain a substantially constant pressure while flow conditions are being monitored. Even more preferably, an increased or "overstressed" pressure differential is first developed between the test interval and the surrounding formation. The increased pressure differential is maintained at a constant value in order to monitor flow conditions for the test interval absent system compliance effects in generally the same manner referred to above. In some applications, the pressure differential is first allowed to decay somewhat and then maintained at a constant value in order to similarly monitor flow conditions for the test interval or borehole. Finally, the problem of packer bypass may be eliminated by selecting the packer assembly to substantially eliminate axial passage of fluid or liquid from the test interval which is not indicative of permeability values to be determined for the surrounding formation. Such conditions may be developed by the use of packers providing a positive seal with the borehole wall to eliminate any possible bypass flow. However, with the packer assembly being arranged far underground, the assurance of such a positive seal is particularly difficult. Accordingly, the method and apparatus of the present invention preferably include the use of a guarded straddle packer assembly of the type disclosed in the above noted copending reference as a means of either eliminating axial leakage or flow from the test interval along the borehole or by also monitoring flow conditions within associated guard zones adjacent the test interval in order to precisely determine the amount of axial flow passing into or out of the test interval from other portions of the borehole.

The invention may be employed in boreholes having any orientation within the underground formation. For example, although the borehole is illustrated as being vertically formed in both of FIGS. 1 and 2, the invention could also be practiced within boreholes extending horizontally, or even at an angle through the formation.

Referring now particularly to FIG. 1, the packer assembly 10 which is illustrated as being of a guarded straddle packer type may be raised or lowered in the borehole by means of the tubing string 22. As the packer assembly is raised in the borehole, the tube bundle 24 is also raised and lowered in order to provide necessary communication between the packer assembly and the surface.

Briefly, the packer assembly 10 includes the two primary packers 18 and 20 described above for forming the test interval 16. In addition, guard packers 28 and 30 are arranged in spaced apart relation from the respective packers 18 and 20 in order to form isolated guard zones 32 and 34 at opposite ends of the test interval 16. With such an arrangement, flow conditions including but not limited to pressure, volumetric change, temperature, etc., may be monitored in the guard zones 32 and 34 as well as in the test interval 16 itself in order to better determine permeability for the surrounding formation. Note the possible use of additional variable volume devices in the guard zones as described below.

Operation of the guarded packer assembly 10 for developing such information is described and claimed in detail within the above noted copending reference. Accordingly, that reference is incorporated herein as if set out in its entirety and the manner of monitoring flow conditions within the guard zones 32 and 34 as well as in the test interval 16 is not described in detail. In any event, the monitoring of flow conditions within the guard zones permits the detection and elimination of leakage effects about the individual packers as well as permitting differentiation between multi-directional components of permeability for the surrounding formation. As was also described in the above noted reference, such determinations are further facilitated by the use of tracer materials which may be introduced on the high pressure side of any of the individual packers. Both arrival time and concentration of the tracer material may be sensed on the low pressure side of the packers in order to provide additional data for assessing both leakage of fluid along the borehole as well as in defining specific characteristics for the underground formation itself.

The packers 18, 20 and 28, 30 are of a conventional type, the specific construction of the packers not being a feature of the present invention. Very generally, the packers are preferably of an inflatable type including rubber jackets which may be expanded by introduction of gases or liquids in order to urge the jackets into sealing engagement with the borehole to define and isolate the test interval 16 as well as the guard zones 32 and 34.

In addition to the guard zones 32 and 34 formed at opposite ends of the test interval 16, it may be seen that the guard packers 28 and 30 respectively form end regions or zones 36 and 38 within the borehole at opposite ends of the packer assembly. These end zones extend respectively to the surface and to the bottom of the borehole.

The tube bundle 24 includes means for communicating necessary flow data to the surface. For example, the tube bundle may include lines for communication with thermistors and pressure transducers arranged within the various zones defined by the packer assembly as described above. In addition, the tube bundle may include means (not shown) for introducing tracer materials into selected areas such as the test interval as well as providing communication with scintillators or the like (not shown) arranged on low pressure sides of the packers for detecting both initial arrival and continuing concentration of the tracers.

The variable volume device 26 preferably includes a cylinder 40 extending alongside the tubing string 22, a piston 42 being arranged in sealed relation within the cylinder while being extendable and retractable in order to provide a varying effective volume within the test interval itself. Extension and retraction of the piston within the cylinder may be accomplished by any of a variety of conventional means. Preferably, the cylinder and piston assembly is operated by a conventional stepper motor schematically illustrated at 44.

The cylinder and piston assembly may operate at a predetermined rate of volume change while pressure and other flow conditions are being monitored within the test interval and other portions of the packer assembly. However, as noted above, the cylinder and piston assembly is preferably adapted for operation in response to a pressure monitoring transducer 46 adapted to instantaneously sense pressure within the test interval. The motor means 44 for the cylinder and piston assembly is preferably interconnected with the pressure monitor 46 by suitable interlinking means such as a servomechanism 48 so that the cylinder and piston assembly expand or contract in order to maintain constant pressure and accordingly measure flow within the test interval.

It is believed that the method of operation for the present invention will be apparent from the preceding description of the FIG. 1 embodiment. However, the method of operation is also set forth below in order to assure understanding of the invention. Before proceeding with a description as to the method of operation, it is to be noted that the invention may be employed for both "in-flow" and "out-flow" type operations. The pressure traces illustrated in FIGS. 3 and 4 are for an out-flow type operation where the pressure within the test interval is raised above the ambient pressure for the surrounding formation. It will be apparent that the invention is equally adaptable to in-flow type operations simply with the pressure differential including a lower pressure in the test interval compared to the ambient pressure for the surrounding formation.

In operation, the packer assembly is first located within the borehole in order to properly define the test interval 16 and the guards 32 and 34, the packers being expanded into sealed engagement with the borehole wall to form and isolate those various intervals and zones.

Referring also to FIG. 3, an initial pressure differential is then developed between the test interval and the surrounding formation. The ambient pressure for the surrounding formation is indicated at 50, the initial pressure differential being developed by raising pressure within the test interval to a peak indicated at 52. Because of permeability characteristics for the surrounding formation, the pressure differential developed between the ambient pressure 50 and the pressure peak 52 normally tends to decay along a curve represented by the broken line trace indicated at 54. However, in accordance with the present invention, the variable volume device 26 is operated in order to limit pressure change within the test interval. For example, the variable volume device 26 could be programmed to expand at a predetermined rate which would reduce but not eliminate variation of pressure within the test interval from the peak 52. Such a condition is represented by the solid line pressure trace indicated at 56.

As particularly contemplated for the embodiment of FIG. 1, the single variable volume device or cylinder and piston assembly 26 is initially operable to expand and develop the pressure differential between the ambient pressure 50 and initial pressure peak 52. Thereafter, the same variable volume device 26 is operable to limit pressure change within the test interval as represented by the pressure trace 56. Flow conditions within the test interval, the guard zones and the end zones for example may all be simultaneously monitored during that time period in order to develop information from which permeability and other characteristics for the surrounding formation may be inferred.

A preferred method of operation is further illustrated in FIG. 4 which represents the same ambient pressure at 50. However, an excess pressure differential is then developed by increasing the pressure within the test interval to a higher pressure 52'. Pressure within the test interval is then maintained at a constant level as indicated by the trace portion 58. Flow conditions within the test interval, guard zones and end zones are then monitored while constant pressure is maintained within the test interval. Alternatively, pressure in the test interval could be allowed to initially decay as indicated by the broken line trace at 59 and then operating the variable volume device 26 to maintain a constant pressure as indicated at 60. However, it remains preferable to employ the constant pressure technique indicated by the trace 58 so that compliance effects for the packer assembly are substantially eliminated throughout the entire test period.

Another embodiment of the packer assembly and the variable volume device are represented in FIG. 2. The packer assembly of FIG. 2 is a modification adapted for whole hole testing adjacent an end 62 of the borehole 12'. Since the embodiment of FIG. 2 includes certain components which closely conform to similar components in FIG. 1, primed numerical labels are employed in FIG. 2 corresponding to the numerical labels for the corresponding components of FIG. 1. The packer assembly 10' of FIG. 2 includes a single primary packer 18' and a single guard packer 28'. The test interval 16' is formed between the single primary packer 18' and the end of the borehole 62. A single guard zone 32' is also formed between the packers 18' and 28'.

The variable volume device 26' of FIG. 2 includes two cylinder and piston assemblies indicated respectively at 64 and 66. Each of the cylinder and piston assemblies 64 and 66 includes generally similar components as described for the single device in FIG. 1. For example, each of the cylinder and piston assemblies is operated by respective motor means 68 and 70 through servo-mechanisms 72 and 74 which are both responsive to a single pressure monitoring transducer 46'. The cylinder and piston assembly 64 has a relatively larger effective variable volume than the other cylinder and piston assembly 66.

In operation, the embodiment of FIG. 2 functions in essentially the same manner as decribed above in connection with FIG. 1. As in conventional whole hole testing techniques, fluid passes between the test interval 16' and the surrounding formation 14' through the cylindrical walls of the borehole 12' as well as through the borehole end 62. However, flow conditions are monitored within the test interval 16', the guard zone 32' and the end zone 36' in the same manner.

Within the embodiment of FIG. 2, the initial pressure differential is developed between the test interval and the surrounding formation by the relatively larger cylinder and piston assembly 64. The smaller and piston assembly 66 is then operated in order to either limit pressure change within the test interval or even to maintain constant pressure within the test interval as described above in connection with FIG. 4.

As noted above, the invention also contemplates the possible use of additional variable volume devices similar to those indicated at 26 in other isolated volumes of the borehole, particularly in one or both of the guard zones 32 and 34 of the embodiment of FIG. 1 as well as the single guard zone 32' of FIG. 2. Accordingly, additional variable volume devices similar to those indicated at 26 and 26' in FIGS. 1 and 2 are illustrated in phantom within the various guard zones as indicated at 80. The variable volume devices 80 would probably be of relatively smaller size than those indicated at 26 and 26' because of the smaller volumes formed by the guard zones.

The substantially greater length of the test interval 16 is relative to the guard zones may at times result in greater flow between the test interval and the surrounding formation, making it more feasible to then employ conventional flow monitoring means in the test interval. At the same time, there may be significantly less flow into or out of the guard zones in the embodiment of either FIG. 1 or 2. Accordingly, the method and apparatus of the present invention could be employed only in one or more guard zones of the straddle packer assembly while other means are employed for measuring flow into or out of the test interval.

The method and apparatus of the present invention have been described in detail above in connection with the separate embodiments of FIGS. 1 and 2. Various modifications and additions are believed apparent from the description. Accordingly, the scope of the invention is defined only by the following appended claims.

What is claimed is:

1. In a method for monitoring flow conditions within a test interval of a borehole, the borehole being filled with a substantially incompressible fluid capable of flow between the test interval and the surrounding formation, the steps comprising developing a pressure differential between the test interval and the surrounding formation for inducing flow therebetween, arranging a variable volume device in communication with the test interval, and varying the effective volume of the variable volume device in order to limit pressure variation in the test interval and minimize system compliance effects while simultaneously monitoring selected flow conditions within the test interval, operation of the variable volume device being regulated in order to maintain substantially constant pressure within the test interval.

2. The method of claim 1 wherein pressure within the test interval is initially increased above pressure in the surrounding formation in order to induce outflow conditions within the test interval and thereafter increasing effective volume of the variable volume device in order to compensate for fluid flow from the test interval into the surrounding formation.

3. The method of claim 1 wherein pressure within the test interval is initially decreased below pressure in the surrounding formation in order to induce inflow conditions within the test interval and thereafter decreasing effective volume of the variable volume device in order to compensate for fluid flow into the test interval from the surrounding formation.

4. The method of claim 1 further comprising means for monitoring pressure within the test interval, the variable column device being responsive to said means for maintaining constant pressure within the test interval.

5. The method of claim 1 wherein the variable volume device comprises a cylinder and piston assembly.

6. The method of claim 1 wherein the test interval is formed along the length of the borehole by at least one expandable primary packer.

7. The method of claim 6 wherein the test interval is formed between one expandable primary packer and an end of the borehole.

8. The method of claim 7 further comprising an additional expandable guard packer arranged in spaced-apart relation relative to the one primary packer for forming a guard zone adjacent the test interval.

9. The method of claim 6 wherein two expandable primary packers are arranged in spaced-apart relation along the borehole to define the test interval, two additional expandable guard packers being arranged in respective spaced-apart relation to the primary packers for forming guard zones at each end of the test interval.

10. The method of claim 1 wherein an initial increased pressure differential is formed between the test interval and the surrounding formation, the increased pressure differential being substantially maintained at a generally constant value by means of the variable volume device during monitoring of flow conditions within the test interval in order to compensate for compliance effects.

11. The method of claim 1 wherein an initial increased pressure differential is formed between the test interval and the surrounding formation, the increased pressure differential being allowed to decay and then being substantially maintained at a generally constant value by means of the variable volume device during monitoring of flow conditions within the test interval in order to compensate for compliance effects.

12. The method of claim 1 further comprising the step of monitoring displacement of the variable volume device as an indication of flow between the test interval and the surrounding formation.

13. The method of claim 12 further comprising the step of monitoring pressure within the test interval and simultaneously monitoring displacement of the variable volume device.

14. The method of claim 12 further comprising monitoring means for monitoring pressure within the test interval and additional means for operating the variable volume device in response to the pressure monitor in order to maintain constant pressure in the test interval while displacement of the variable volume device is being monitored.

15. In a method for monitoring flow conditions within a test interval of a borehole, the borehole being filled with a substantially incompressible fluid capable of flow between the test interval and the surrounding formation, the steps comprising developing a pressure differential between the test interval and the surrounding formation for inducing flow therebetween, arranging a variable volume device in communication with the test interval, and varying the effective volume of the variable volume device in order to limit pressure variation in the test interval and minimize system compliance effects while simultaneously monitoring selected flow conditions within the test interval, and further comprising means for initially developing the pressure differential between the test interval and the surrounding formation, said means for developing the pressure differential comprising a second variable volume device.

16. In a method for monitoring flow conditions within a test interval of a borehole, the borehole being filled with a substantially incompressible fluid capable of flow between the test interval and the surrounding formation, the steps comprising developing a pressure differential between the test interval and the surrounding formation for inducing flow therebetween, arranging a variable volume device in communication with the interval, and varying the effective volume of the variable volume device in order to limit pressure variation in the test interval and minimize system compliance effects while simultaneously monitoring selected flow conditions within the test interval, the variable volume device being initially operable for developing the pressure differential between the test interval and the surrounding formation, effective volume of the variable device thereafter being varied in order to limit pressure variation within the test interval.

17. The method of claim 16 wherein said variable volume device includes a first cylinder and piston assembly for developing the pressure differential within the test interval and a second cylinder and piston assembly for thereafter limiting pressure variation within the test interval during monitoring of selected flow conditions within the test interval.

18. Apparatus for monitoring flow conditions within a test interval of a borehole filled with a substantially incompressible fluid capable of flow between the test interval and the surrounding formation, comprising a packer assembly for defining the test interval along the borehole, means for developing a pressure differential between the test interval and the surrounding formation for inducing flow therebetween, a variable volume device arranged in communication with the test interval, means for regulating operation of the variable volume device in order to limit pressure variation in the test interval and minimize system compliance effects, and means for simultaneously monitoring selected flow conditions within the test interval, the means for regulating the variable volume device being adapted to maintain substantially constant pressure within the test interval.

19. The apparatus of claim 18 further comprising means for monitoring pressure within the test interval, the means for regulating the variable volume device being responsive to said pressure monitoring means.

20. The apparatus of claim 18 wherein the variable volume device comprises a cylinder and piston assembly.

21. The apparatus of claim 18 further comprising one variable volume device for initially developing the pressure differential between the test interval and the surrounding formation and a second variable volume device for thereafter limiting pressure variation in the test interval.

22. The apparatus of claim 21 wherein the one variable volume device and the additional variable volume device are cylinder and piston assemblies.

23. The apparatus of claim 18 wherein the packer assembly includes at least one expandable packer for forming the test interval.

24. The apparatus of claim 26 wherein the test interval is formed between the one expandable primary packer and an end of the borehole.

25. The apparatus of claim 24 further comprising an additional expandable guard packer arranged in spaced-apart relation relative to the one primary packer for forming a guard zone adjacent the test interval.

26. The apparatus of claim 23 wherein two expandable primary packers are arranged in spaced-apart relation along the borehole to define the test interval, two additional expandable guard packers being arranged in respective spaced-apart relation to the primary packers for forming guard zones at each end of the test interval.

27. The apparatus of claim 21 further comprising means for monitoring displacement of the variable volume device in order to detect flow between the test interval and the surrounding formation.

28. In a method for monitoring flow conditions within a borehole containing substantially incompressible fluid capable of flow between the test interval and the surrounding formation, the steps comprising forming a test interval and at least one adjacent guard zone within the borehole by means of expandable packers, arranging a variable volume device in communication with the guard zone, developing a pressure differential between the test interval and the surrounding formation for inducing flow therebetween, and monitoring selected flow conditions within the test interval and simultaneously varying the effective volume of the variable volume device in order to limit pressure variation in the guard zone while simultaneously monitoring selected flow conditions therein, the test interval being formed between a primary packer and an end of the borehole.

29. The apparatus of claim 28 wherein selected flow conditions within the test interval are also monitored by means of a variable volume device.

30. In a method for monitoring flow conditions within a borehole containing substantially incompressible fluid capable of flow between the test interval and the surrounding formation, the steps comprising, forming a test interval and at least one adjacent guard zone within the borehole by means of expandable packers, arranging a variable volume device in communication with the guard zone, developing a pressure differential between the test interval and the surrounding formation for inducing flow therebetween, and monitoring selected flow conditions within the test interval and simultaneously varying the effective volume of the variable volume device in order to limit pressure variation in the guard zone while simultaneously monitoring selected flow conditions therein, the test interval being formed between two primary packers, two additional expandable guard packers being arranged in respective spaced-apart relation to the primary packers for forming guard zones at each end of the test interval, flow conditions within each guard zone being similarly monitored by means of a variable volume device.

31. The method of claim 30 wherein selected flow conditions within the test interval are also monitored by means of a variable volume device.

32. Apparatus for monitoring flow conditions within a borehole containing a substantially incompressible fluid capable of flow between the borehole and the surrounding formation, comprising a packer assembly for defining a test interval along the borehole and at least one guard zone adjacent one end of the test interval, means for developing a pressure differential between the test interval and the surrounding formation for inducing flow therebetween, means for monitoring selected flow conditions within the test interval, a variable volume device arranged in communication with the guard zone, and means for regulating operation of the variable volume device in order to limit pressure variation in the guard zone and for simultaneously monitoring selected flow conditions within the guard zone, the test interval being formed between a primary packer and an end of the borehole.

33. The apparatus of claim 32 wherein selected flow conditions within the test interval are also monitored by means of a variable volume device.

34. Apparatus for monitoring flow conditions within a borehole containing a substantially incompressible fluid capable of flow between the borehole and the surrounding formation, comprising a packer assembly for defining a test interval along the borehole and at least one guard zone adjacent one end of the test interval, means for developing a pressure differential between the test interval and the surrounding formation for inducing flow therebetween, means for monitoring selected flow conditions within the test interval, a variable volume device arranged in communication with the guard zone, and means for regulating operation of the variable volume device in order to limit pressure variation in the guard zone and for simultaneously monitoring selected flow conditions within the guard zone, the test interval being formed between two primary packers, two additional expandable guard packers being arranged in respective spaced-apart relation to the primary packers for forming guard zones at each end of the test interval, flow conditions within each guard zone being similarly monitored by means of a variable volume device.

35. The apparatus of claim 34 where selected flow conditions within the test interval are also monitored by means of a variable volume device.

* * * * *

UNITED STATES PATENT AND TRADEMARK OFFICE

CERTIFICATE OF CORRECTION

PATENT NO. : 4,392,376

DATED : July 12, 1983

INVENTOR(S) : Lagus, Peterson and Hicks

It is certified that error appears in the above-identified patent and that said Letters Patent is hereby corrected as shown below:

Column 10, Line 51: "decribed" should read --described--.

Column 11, Line 55, (Claim 4): "column" should read -- volume--.

Signed and Sealed this

*Eighth* Day of *November 1983*

[SEAL]

*Attest:*

GERALD J. MOSSINGHOFF

*Attesting Officer*

*Commissioner of Patents and Trademarks*